United States Patent [19]

Scrivens

[11] Patent Number: 4,523,335

[45] Date of Patent: Jun. 18, 1985

[54] SURGICAL GOWN

[75] Inventor: George W. Scrivens, Arlington, Tex.

[73] Assignee: Surgikos, Inc., Arlington, Tex.

[21] Appl. No.: 532,348

[22] Filed: Sep. 15, 1983

[51] Int. Cl.[3] ..... A41B 13/10; A41H 33/00

[52] U.S. Cl. ..... 2/51; 2/114; 2/DIG. 7; 223/37; 223/38; 128/165

[58] Field of Search ..... 2/114, 51, DIG. 7; 223/37, 38; 128/165

[56] References Cited

U.S. PATENT DOCUMENTS 3,359,569 12/1967 Rotanz et al. ..... 2/114

3,540,441 11/1970 Collins ..... 128/165

*Primary Examiner*—Doris L. Troutman

*Attorney, Agent, or Firm*—Michael O. Tatlow

[57] ABSTRACT

A surgical gown is disclosed in which the main body of the gown is fan folded around transversely extending fold lines. The sleeves of the gown are inserted between the lowermost fold or bottom fold in the gown and the next adjacent fold. The donning of the gown forces the lowermost fold away from the remainder of the gown eliminating any problem of blocking of the gown.

2 Claims, 6 Drawing Figures

SURGICAL GOWN

The present invention relates generally to surgical gowns and more particularly to a surgical gown which is folded in a configuration to allow the gown to readily unfold to completely open the gown.

BACKGROUND OF THE INVENTION

Disposable surgical gowns have largely displaced reusable linen gowns in the operating rooms. Disposable surgical gowns provide better protection against possible bacterial contamination from the surgeon to the patient because they do not have tears or openings which may be present in linen gowns. In addition, disposable surgical gowns are made with repellent fabrics which prevent the wetting of the gown and the possible transmission of bacteria between the patient and surgeon through the wetted surfaces of the gown. The fabrics from which disposble gowns are made are generally nonwoven fabrics which contain a binder material as part of the nonwoven fabric. The fabrics may also contain various repellent and fabric finishes on the surface of the gown. Because of these binder materials, repellent and fabric finishes, it has been found that some disposable operating gowns have a tendency for their surfaces to adhere together or block following the normal sterilization of these gowns prior to use. The gowns are generally folded into a compact configuration for packaging and for ease in donning the gown by the operating room staff. U.S. Pat. No. 3,359,569 shows a typical folding sequence for such gowns. The gowns are generally manufactured, folded into a compact package and sterilized before sale. The sterilization cycles, in which either steam or ethylene oxide gas at elevated temperatures is employed, or radiation sterilization have a tendency to cause the blocking characteristics of the fabric. Generally, the upper folds of the gown will not block because the weight of the lower folds of the gown is sufficient to open the gown. However, the lowermost portion of the gown will often block and not completely unfold and will remain secured to the adjacent fold in the gown. In order to fully unfold the gown, it is necessary for a member of the operating room staff to touch the outside surface of the gown. This contact with the outside surface of the lower portion of the gown is considered to render the gown contaminated according to the strict procedures of asceptic operating room techniques.

The present invention provides a gown which has a folding sequence which totally eliminates this problem. In the present gown, the sleeves are interleaved in the folds of the gown between the lowest portion of the folded gown and the next folded portion of the gown so that when the surgeon or other operating room personnel puts their arms through the sleeves, they will inherently push out the lowest portion of the gown and prevent the blocking problem referred to above.

DETAILED DESCRIPTION OF THE DRAWINGS

Figure 1:
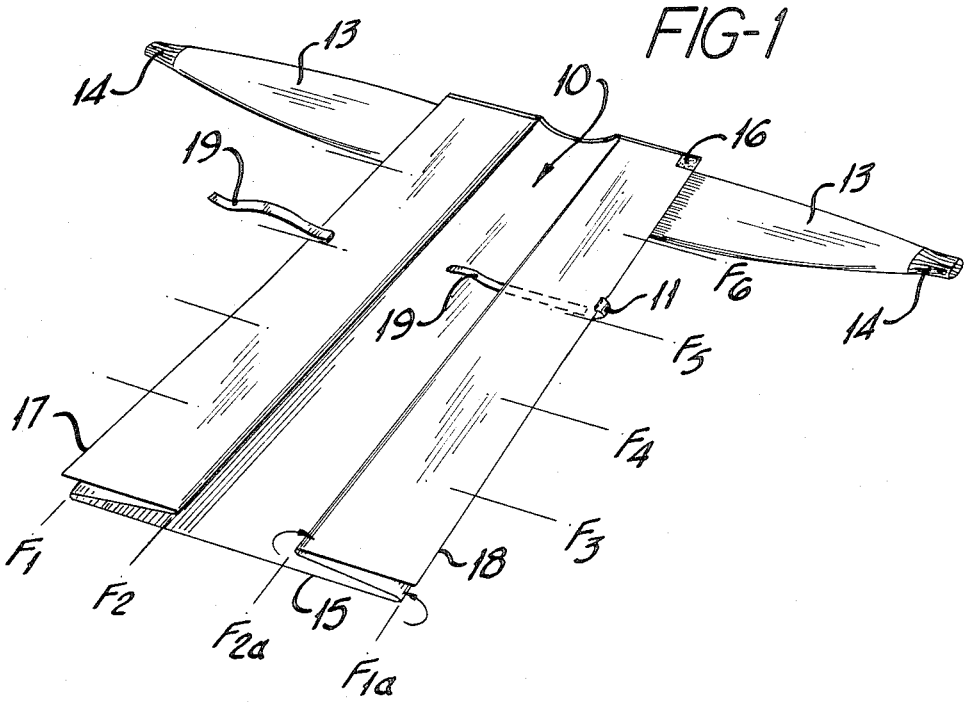
FIG. 1 shows an isometric view of the gown and particularly the back portion of the gown.

The gown of the present invention is a back-closing gown which comprises a main sheet 10 with sleeves 13 attached to the gown. There are tubular knitted cuffs 14 sewn or otherwise secured to the end of each sleeve. There is a neck closure 16, usually a VELCRO fastener, which is used to secure the neck of the gown in a closed position. Other neck closures, such as snaps or ties, may also be used as is common in the art. The gown has a waist closure of the type disclosed in U.S. Pat. No. 3,935,556. The waist closure comprises two ties 11 attached to the gown at approximately the waist level. The free end of each tie is releasably attached to a transfer device 12. The transfer device 12 is employed to aseptically move the ties to the side or back of the wearer of the gown where the ties are secured. The gown may have additional ties 19 which are tied to avoid gapping in the back of the gown. The particular waist closure is not part of the present invention.

Figure 2:
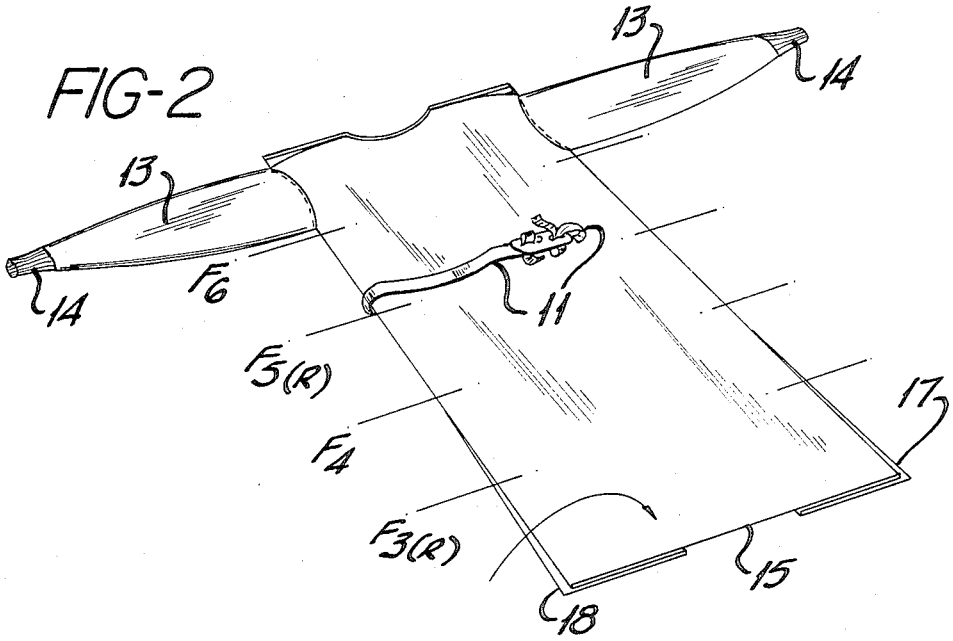
FIG. 2 shows an isometric view of the front portion of the gown in a flat configuration.
Figure 3:
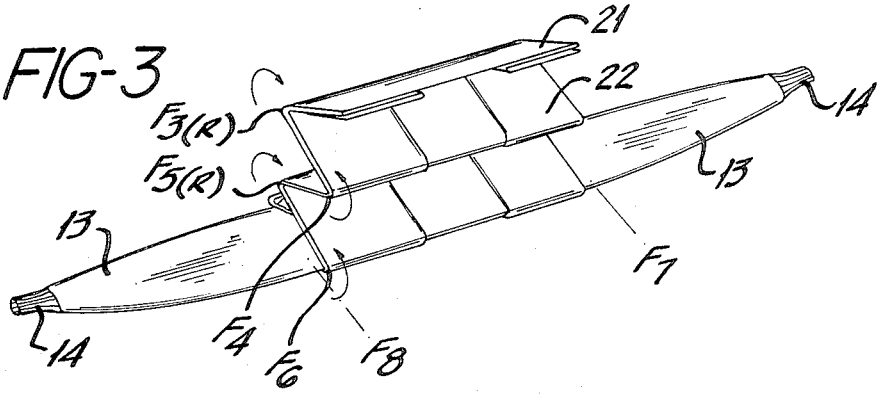
FIG. 3 shows the folding sequence of the main portion of the gown.

The front portion of the gown is shown in FIG. 2 and comprises a continuous nonwoven fabric. It is desirable not to include any seams or other openings in the front portion of the gown, as the front portion of the gown may come in contact with the patient, and any opening in the gown such as a seam may provide a passage for bacteria-laden fluid. This bacteria-laden fluid could contaminate the surgical staff and possibly recontaminate the patient. As shown in FIGS. 1 and 2, sleeves 13 are attached to the top portion of the gown. The knitted cuffs on the sleeves allow the sleeves to tightly conform to the wrists of the wearer. The back portion of the gown has longitudinally extended edges 17 and 18 which are secured to each other to close the back of the gown when in use.

Figure 4:
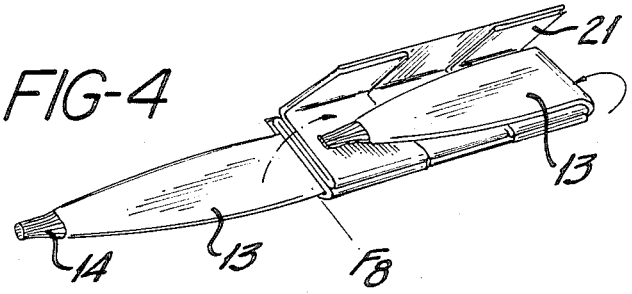
FIG. 4 shows the sleeves being interleaved between the lowermost fold in the main body of the gown and the next adjacent fold.

The folding sequence of the gown is shown in FIGS. 1–6. In the following description of the folding sequence of the gown the term "longitudinal fold line" is a line in a direction parallel to the length of the gown, i.e., from the top or neck of the gown to the bottom of the gown. The term "transverse fold line" is a fold line generally perpendicular to a longitudinal fold line. The term "forward fold" is a fold where a portion of the front of the gown is folded into another portion of the front of the gown. A "reverse fold" is a fold where a portion of the back gown is folded into another portion of the back of the gown. Alternate forward and reverse folds result in a fan folded sequence. In folding the gown, the gown is laid flat, and the left and right side edges 17 and 18 of the back portion of the gown are folded along longitudinal fold lines F1 and F1A, respectively, and then reverse folded along longitudinal fold lines F2 and F2A, respectively, so that the back panels of the gown lay along the side edges of the gown. The lower portion of the gown is then fan folded in alternate forward and reverse folds toward the top or neck of the gown along the transverse fold lines F3, F4, F5 and F6 in overlapping folds to form a compact fold sequence for the main body of the gown. As shown in FIG. 4, the sleeves are then folded along lines F7 and F8 and placed between the lowermost folded portion of the gown 21 and the next adjacent fold 22. The positioning of the sleeves in this location will insure that the bottom portion 15 of the gown will not block or adhere to the remainder of the gown when the gown is put on by the wearer.

Figure 5:
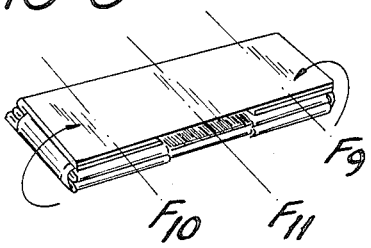
FIG. 5 shows the remaining folding sequence for the gown.
Figure 6:
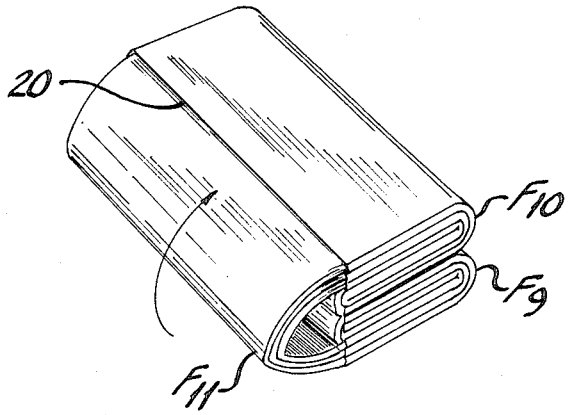
FIG. 6 shows a compactly folded surgical gown of the present invention.

As shown in FIG. 5, after the sleeves have been inserted between the lowermost fold of the gown and the next adjacent fold, the gown is folded along longitudinally-extending fold lines F9 and F10 to form a compact folded gown. The gown is again folded along lines F11 to form a suitable size folded gown for packaging. It should be noted in FIG. 6 that the opening 20 shown in FIG. 6 is the arm opening of the sleeve. The folded gown shown in FIG. 6 presents the interior of the gown to the wearer so that the wearer may grasp the gown and insert his hands into the openings 20 and don the gown. This action will force out the sleeves and in doing so, the bottom or lowest fold 21 of the gown will be separated from the remaining portion of the gown. This avoids any problem of blocking of the fabric at the lower portion of the gown. The problem of blocking usually does not occur in the upper folds of the gown since the remaining weight of the gown is sufficient to separate the folded portions of the gown.

I claim:

1. A surgical gown comprising a main sheet and sleeves integrally attached thereto, said main sheet having a closed front portion and an open back portion, said back portion being folded along longitudinal fold lines extending the length of said gown to form folds laying along the side edges of the gown, said gown being fan folded along transverse fold lines from the bottom of the gown toward the top of the gown to form a series of overlapping folds, the sleeves of said gown being folded over the main body of the gown between the lowermost fold of said gown and the fold adjacent the lowermost fold, the gown then being folded along the longitudinal fold lines to form a compactly folded gown presenting the interior surface of the gown to the wearer.

2. The gown of claim 1 in which the side edges of the back of the gown are first forward folded and then reverse folded along longitudinally extending fold lines to provide an open back of the folded gown.

* * * * *